US007971299B2

(12) United States Patent
Soifer

(10) Patent No.: US 7,971,299 B2
(45) Date of Patent: Jul. 5, 2011

(54) MATTRESS WITH ONE OR MORE HIDDEN CAVITIES FOR STORING VALUABLES

(76) Inventor: Oscar Soifer, Dayton, OH (US)

( * ) Notice: Subject to any disclaimer, the term of this patent is extended or adjusted under 35 U.S.C. 154(b) by 0 days.

(21) Appl. No.: 12/800,055

(22) Filed: May 7, 2010

(65) Prior Publication Data

US 2011/0088169 A1 Apr. 21, 2011

Related U.S. Application Data

(60) Provisional application No. 61/279,249, filed on Oct. 19, 2009.

(51) Int. Cl.
*A47C 31/00* (2006.01)

(52) U.S. Cl. ..... 5/694; 5/308; 5/503.1; 5/931

(58) Field of Classification Search ..... 5/694, 931, 5/58, 308, 503.1
See application file for complete search history.

(56) References Cited

U.S. PATENT DOCUMENTS

| | | | | |
|---|---|---|---|---|
| 433,905 | A * | 8/1890 | Muller | 5/694 |
| 2,895,145 | A * | 7/1959 | Soifer | 5/308 |
| 3,287,749 | A | 11/1966 | Marsico | |
| 5,896,605 | A | 4/1999 | Branman | |
| 6,292,960 | B1 | 9/2001 | Bowling | |
| 6,684,432 | B2 * | 2/2004 | Owens, Jr. | 5/694 |

* cited by examiner

*Primary Examiner* — Fredrick Conley
(74) *Attorney, Agent, or Firm* — Robert M. Downey, P.A.

(57) ABSTRACT

A mattress has at least one cavity that is covered by a flap formed by the top quilt or covering of the mattress. The cavity is formed by eliminating one or more foam layers corresponding to the size, shape and depth of the desired cavity. In a preferred embodiment, two or more cavities are provided, each at a corner of the mattress. The top quilt, forming the flap, is secured with the use of releasable fasteners, such as hook and loop fasteners, to completely conceal the pocket when closed. The releasable fasteners allow the flap to be conveniently opened and closed so that jewelry, currency or other valuables and items can be placed within or removed from the one or more hidden cavities. The manner of creating the hidden cavity allows for ease in manufacturing without additional cost, labor or materials other than the releasable fasteners.

4 Claims, 1 Drawing Sheet

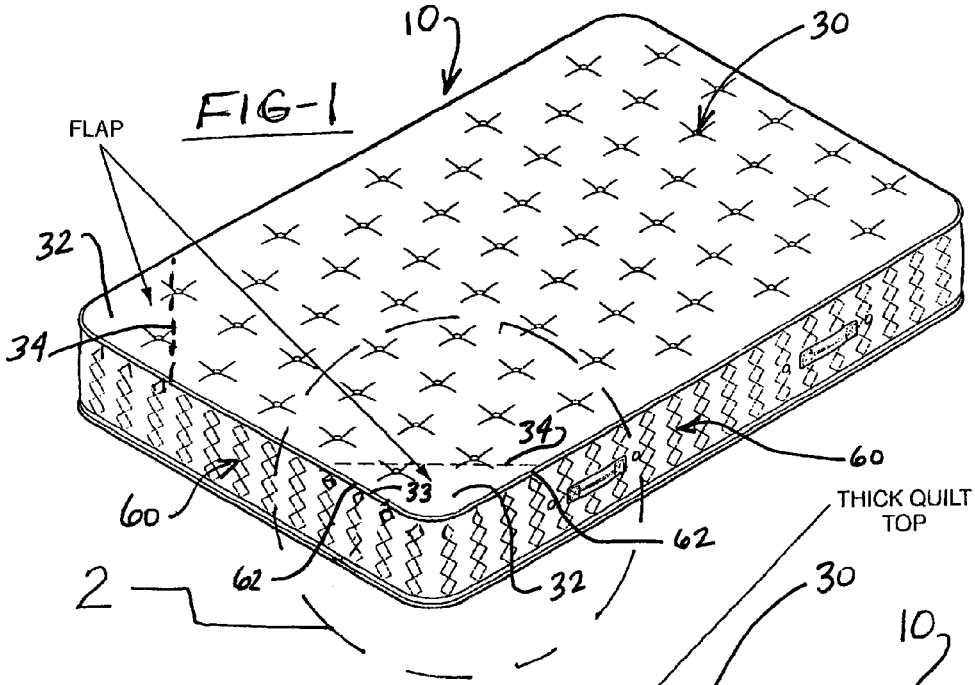
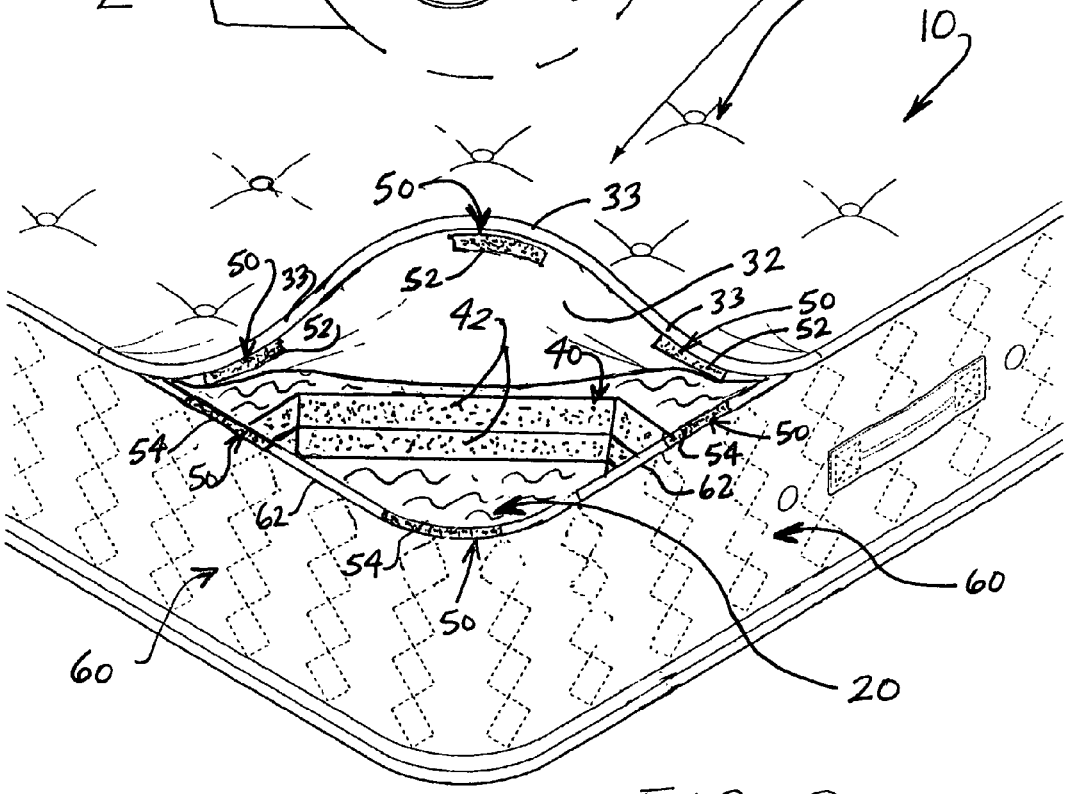
FIG-2

MATTRESS WITH ONE OR MORE HIDDEN CAVITIES FOR STORING VALUABLES

This non-provisional patent application is based on provisional patent application Ser. No. 61/279,249 filed on Oct. 19, 2009.

BACKGROUND OF THE INVENTION

1. Field of the Invention

The present invention relates to storage pockets and chambers within a mattress and, more particularly, to a mattress having one or more hidden pockets covered and concealed by a movable portion of the top quilt or covering of the mattress.

2. Discussion of the Related Art

Many people prefer to store their jewelry, cash and other valuable items in a hidden location so that their valuables will not be stolen in the event their home is burglarized. The typical hiding places for such valuables include dresser drawers, wood boxes, jars, containers and kitchen cabinets. Probably the best known hiding spot, especially for cash, is under one's mattress (i.e., between the mattress and the boxspring). Unfortunately, most burglars know all of these hiding places and will usually find jewelry, cash and other valuables in a matter of a few minutes when robbing a home.

While many people do prefer to hide their valuables in or close to their bedroom, hiding places such as "under the mattress" are not effective and should be avoided. Rather than hiding valuables under the mattress, it would be far more effective to hide jewelry, cash and other valuables within the mattress. However, this hiding location will only work if the storage compartment within the mattress is completely concealed without any visible access openings. A mattress having an interior hiding compartment must have the appearance of a typical conventional mattress. Moreover, the one or more hiding compartments in the mattress must be easy to access by the owner so that they may store and remove their valuables from the hidden compartment in the mattress without difficulty. Finally, a mattress with a hidden compartment for storing valuables must be easy to manufacture without deviating from the manufacturing process or adding a significant amount of cost for additional labor or materials.

Accordingly, there remains a need for a mattress having one or more hidden cavities for storing jewelry, cash and other valuable items, and wherein the one or more cavities are formed by eliminating some of the foam material below the top quilt of covering of the mattress according to the desired size and shape of the cavity, and further wherein the top quilt is secured by a releasable fastener (e.g., hook and loop fasteners) to close the hidden cavity in a manner that completely conceals the cavity with no visible indicators of an access opening.

SUMMARY OF THE INVENTION

The present invention is directed to a mattress having at least one cavity for storing jewelry, currency or other valuables and items in a secure hiding place. In a preferred embodiment, several cavities are provided, each at a corner of the mattress. The cavities may be formed at the two top corners of the mattress, and may also be formed at the corners on the opposite side of the mattress so that they can be accessed in the event that the mattress is flipped. Each cavity is formed by eliminating one or more foam layers under the quilted top or covering of the mattress. The amount of eliminated mattress foam corresponds to the desired size, shape and depth of the cavity. Each cavity is covered by a movable flap that is formed by the quilted top. Releasable fasteners, such as hook and loop fasteners, secure the flap to the side covering of the mattress to completely conceal the pocket when the flap is closed. The releasable fasteners allow the flap to be conveniently opened and closed so that the valuables or other items can be placed within or removed from the hidden cavity with minimal effort.

BRIEF DESCRIPTION OF THE DRAWINGS

For a fuller understanding of the nature of the present invention, reference should be made to the following detailed description taken in conjunction with the accompanying drawings in which:

FIG. 1 is a top perspective view of a mattress having two hidden cavities, each at a top corner of the mattress directly below the quilted top; and FIG. 2 is an isolated perspective view, taken from the area indicated as 2 in FIG. 1, illustrating movement of a flap, formed by a portion of the quilted top, to an open position in order to reveal the cavity and provide access to the hidden cavity within the mattress.

Like reference numerals refer to like parts throughout the several views of the drawings.

DETAILED DESCRIPTION OF THE PREFERRED EMBODIMENT

Referring to the several views of the drawings, the mattress of the present invention is shown and if generally indicated as 10.

The mattress 10 is provided with one or more hidden cavities 20 for storing jewelry, cash, and other valuables and items. FIG. 1 illustrates a preferred embodiment of the present invention wherein two hidden cavities 20 are formed at the top corners of the mattress 10, directly below the quilted top 30 which provides a generally triangular flap 32 to cover and conceal each cavity 20. Accordingly, when the flap 32 over each cavity 20 is closed, as seen in FIG. 1, the mattress 10 has the appearance of any conventional quilted top mattress and there is no visible indication of a concealed cavity or storage pocket. The flap 32 of each pocket (cavity) 20 lifts open and folds generally along the dashed line 34 shown in FIG. 1.

Referring to FIG. 2, the storage cavity 20, below the flap 32, is formed by removing one or more layers 42 of padding or foam 40 that would normally be used in the construction of a conventional quilted top mattress. In a preferred embodiment, the mattress 10 of the present invention has an interior core, between the opposite quilted tops (top and bottom coverings), that is entirely of a foam material 40. Elimination of the desired amount of foam, preferably during the manufacturing process, provides the storage cavity 20 that is directly below the flap 32. The exact dimensions of the storage cavity 20, including the shape and depth, can be easily achieved by eliminating the appropriate amount of foam material 40. The flap 32 over each hidden storage cavity 20 is secured closed with the use of releasable fasteners 50. In a preferred embodiment, hook and loop fasteners are used for releasable securing the flap 32 in a closed position. Specifically, three sections of corresponding hook and loop releasable fasteners are provided on the flap and the top edge of the side covering of the mattress. More specifically, three sections of a corresponding component of a hook and loop fastener material 52 are stitched, glued or otherwise fastened to an underside of the flap 32, close to the edge 33 of the flap 32, as seen in FIG. 2. The corresponding mating sections of the hook and loop fastener components 54 are positioned on the top edge 62 of the side covering 60 of the mattress for mating, releasable engagement with the hook and loop fastener components 52 on the underside of the flap. Accordingly, when the flap 32 is closed, the sections of hook and loop fastener components 52 on the underside of the flap 32 attach to the correspondingly positioned hook and loop fastener components 54 on the top edge 62 of the side mattress covering 60 to hold the flap closed without any visible sign of an opening. More particularly, when the flap 32 is secured closed, the hook and loop fastener components are not visible and the flap 32 appears to be secured to the side covering 60 of the mattress 10 in the same manner as a remainder of the mattress. Accordingly, the mattress has the appearance of any conventional quilted top mattress.

The hidden cavities 20 may be provided on the top corners of the mattress 10, on each side (i.e., top side and bottom side) of the mattress 10, so that in the event that the mattress is flipped, hidden cavities 20 on the top facing side will always be accessible.

While the present invention has been shown and described in accordance with several preferred and practical embodiments, it is recognized that departures from the instant disclosure are fully contemplated within the spirit and scope of the present invention as defined in the following claims.

What is claimed is:

1. A mattress comprising:

an outer casing enclosing an interior of said mattress and including a top quilt having a surrounding peripheral edge, a bottom covering having a surrounding peripheral edge and a bottom edge, and a side covering having a top edge and a bottom edge, and said top edge of said side covering being joined to said peripheral edge of said top quilt at least partially along a seam that surrounds said mattress;

a filling within said interior of said mattress and including at least one foam layer;

a storage compartment formed at a corner of said mattress in said filling directly below said top quilt and adjacent to said seam, and said storage compartment having a bottom defined by a portion of said at least one foam layer, and said storage compartment further including at least a first vertical wall defined by a portion of said at least one foam layer, at least a second vertical wall defined by a first inner side of said side covering, at least a third vertical wall defined by a second inner side of said side covering, and a generally triangular shaped cover flap defined by a portion of said top quilt, and said cover flap being operably moveable between a closed position to cover and conceal said storage compartment and an open position wherein said peripheral edge of said portion of said top quilt is separated from said top edge of said side covering along a portion of said seam to provide access to said storage compartment; and at least one releasable fastener cooperating between said cover flap and said top edge of said side covering along a portion of said seam for releaseably joining said peripheral edge to said top edge of said side covering and securing said cover flap in said closed position.

2. The mattress as recited in claim 1 wherein said at least one releasable fastener is a hook and loop fastener having cooperating hook and loop fastener components.

3. The mattress as recited in claim 2 wherein said hook and loop fastener components include a first hook and loop fastener component on an underside of said cover flap adjacent to said peripheral edge and a cooperating second hook and loop fastener component on said inner side of said side covering adjacent to said top edge, and wherein said first and second hook and loop fastener components are concealed from view when said cover flap is in said closed position.

4. The mattress as recited in claim 3 further comprising:

a plurality of said storage compartments each positioned at a respective one of a plurality of corners of said mattress.

* * * * *